US006820860B2

(12) United States Patent
Gordon

(10) Patent No.: US 6,820,860 B2
(45) Date of Patent: Nov. 23, 2004

(54) VEHICLE BODY LIFTER

(76) Inventor: Jimmy V. Gordon, P.O. Box 4561, Anniston, AL (US) 36204

( * ) Notice: Subject to any disclaimer, the term of this patent is extended or adjusted under 35 U.S.C. 154(b) by 239 days.

(21) Appl. No.: 10/173,886

(22) Filed: Jun. 19, 2002

(65) Prior Publication Data

US 2003/0010964 A1 Jan. 16, 2003

Related U.S. Application Data

(60) Provisional application No. 60/299,453, filed on Jun. 21, 2001.

(51) Int. Cl.[7] ..... B66F 7/26
(52) U.S. Cl. ..... 254/45
(58) Field of Search ..... 254/45, 47, 7 R, 254/7 B, 7 C, 89 R

(56) References Cited

U.S. PATENT DOCUMENTS

| | | | |
|---|---|---|---|
| 3,321,180 | A | 5/1967 | Hutchinson |
| 3,536,161 | A | 10/1970 | Clarke |
| 3,881,689 | A | 5/1975 | Bury et al. |
| 4,463,937 | A | 8/1984 | Celette |
| 4,986,107 | A | 1/1991 | Peyret |
| 5,016,464 | A | 5/1991 | Tomelleri |
| 5,044,864 | A | 9/1991 | Stefan |
| 5,395,202 | A | 3/1995 | Peters |
| 5,752,408 | A | 5/1998 | Huckabee |

FOREIGN PATENT DOCUMENTS

| | | |
|---|---|---|
| GB | 456259 | 11/1936 |
| JP | 1-190535 | 7/1989 |

*Primary Examiner*—Robert C. Watson
(74) *Attorney, Agent, or Firm*—Richard C. Litman

(57) ABSTRACT

An automotive vehicle body lifter jacking system is described which raises a vehicle' body at selective heights from its frame for restoration and repairs. The body lifter has a rectangular frame made of square steel tubing having threaded apertures at each corner. Elongated, threaded jacking bolts are secured to each respective aperture for selectively lifting a body from the frame of a vehicle. The jacking system is actuated mechanically, hydraulically or electrically to raise the lifter. Wheels are secured to the bottom of each corner for mobility and maneuverability the lifting structure.

18 Claims, 6 Drawing Sheets

VEHICLE BODY LIFTER

CROSS-REFERENCE TO RELATED APPLICATION

This application claims the benefit of U.S. Provisional Patent Application Ser. No. 60/299,453, filed Jun. 21, 2001.

BACKGROUND OF THE INVENTION

1. Field of the Invention

The present invention relates generally to vehicle jacks. More specifically, the invention is an automotive vehicle body lifter or jacking system for removing a vehicle's body off the frame for restorations and/or repairs.

2. Description of Related Art

Numerous vehicle jacks have been devised for lifting and supporting various vehicles and portions thereof for making repairs and/or refurbishing respective portions of the vehicle. Early developments of vehicle mounted jacks are described in the U.S. Pat. No. 3,321,180 issued to Hutchinson in 1967. This particular jack is a four-poster-type screw jack system with motor driven belt tracks mounted around sprockets. As with many of the conventional vehicle jack systems herein described, complex gear, train and track mechanisms have been used to remove or displace external body loads or forces from the frames of vehicles. Consequently, these complex features have contributed to increased maintenance and repair costs over the life of conventional jack systems. A vehicle body lifter which is durable, simple in construction and easy to deploy with reduced maintenance repair costs as herein described is lacking in the following conventional vehicle jack systems.

U.S. Pat. No. 3,536,161 issued to Clarke discloses an overhead frame with four box legs extending downwardly therefrom. Each of the legs has a traveler mounted for movement longitudinally of the leg and raised or lowered with a hydraulic cylinder. At the bottom of each traveler is a wheel to support the lift when the traveler is in the lowered position.

U.S. Pat. No. 3,881,689 issued to Bury, deceased et al. discloses a camper body lifting device which includes wheels. The device is substantially rectangular in construction and has a support member connecting a pair of frames at one end. To each side of the frames, intermediate their ends, a pair of mechanical jacks having a rack tooth bar and a hollow post are vertically mounted.

U.S. Pat. No. 5,395,202 issued to Peters discloses a similar camper lifting device for supporting and lifting a wheelless vehicle mounted camper.

U.S. Pat. No. 4,463,937 issued to Celette discloses an apparatus for a gauge block for the inspection and/or repair of motor vehicle body works. The apparatus comprises two parallel longitudinal members having an I-section. Two cross members are disposed beneath the longitudinal members for movement along the longitudinal members by means of rollers. The extremities of the cross members carry lateral brackets outside the gauge block, and include sliding vertical arms adapted to support the base of the vehicle body.

U.S. Patents issued to Peyret (U.S. Pat. No. 4,986,107), Huckabee (U.S. Pat. No. 5,752,408) and Tomelleri (U.S. Pat. No. 5,016,464) disclose support structures for accident-damaged bodies and/or automotive body repairs. As disclosed in the Huckabee patent the support structure includes a octagonally shaped structure which is secured to the lateral sides of a vehicle's body for body repair. The patent issued to Peyret is directed to a lower rack assembly on wheels for inspecting the under portion or chassis of vehicles. However, the apparatus taught by Tomelleri is a synthesis of the previous two patents wherein a repair wrench operatively mounted to a base or rack assembly having a pair of hydraulic jacks mounted thereto is manipulated on lateral sides of a vehicle's body for effecting repairs or removal from the vehicle's frame.

Other Patents respectively issued and granted to Stefan (U.S. Pat. No. 5,044,864), Hine (GB 456,259) and Kusanao (JP 1190535) disclose conventional lift devices which are considered to be of general relevance to the vehicle body lifter as herein described. Thus, none of the above inventions and patents, taken either singly or in combination, is seen to describe the instant invention as claimed.

SUMMARY OF THE INVENTION

The automotive vehicle body lifter jacking system according to the invention has a rectangular frame made of square steel tubing with threaded receiving apertures disposed therein at each respective corner of the frame. Attached at each corner are respective elongated, threaded jacking bolts used for selectively lifting a body from the frame of a vehicle. A critical lifting height of approximately three inches per bolt is used for providing a predetermined level of rise of the body. The jacking system is actuated mechanically, hydraulically or electrically to raise the lifter in combination with a fixed body. Wheels are secured to the bottom of each corner for mobility and maneuverability of the lifting structure. Each threaded bolt or rod is actuated to provide a lifting height of critical rise per bolt in sequence for fully lifting a body from the frame.

Accordingly, it is a principal object of the invention to provide a vehicle body lifter for lifting a vehicle's body from its supporting frame for body restoration and/or repairs.

It is another object of the invention to provide a vehicle body lifter which is easy to assemble or deploy.

It is a further object of the invention to provide a vehicle body lifter which can be actuated by mechanical, hydraulic or electrical means.

It is an object of the invention to provide improved elements and arrangements thereof in an apparatus for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a vehicle body lifter for raising a vehicle's body B from its frame F. The preferred embodiments of the invention are depicted in FIGS. 1–5, and are generally referenced by numerals 4, 5 and 6 respectively.

Figure 1:
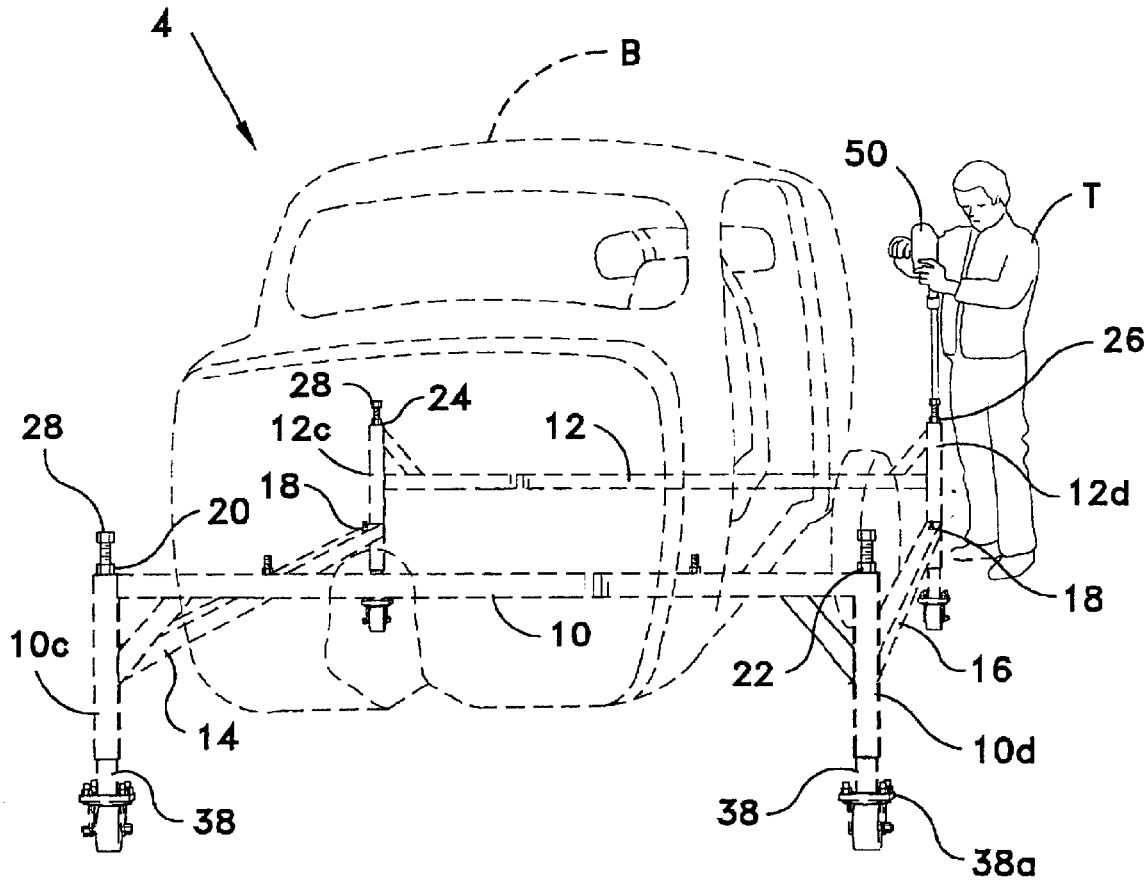
FIG. 1 is an environmental, perspective view of a vehicle body lifter according to the present invention.
Figure 2A:
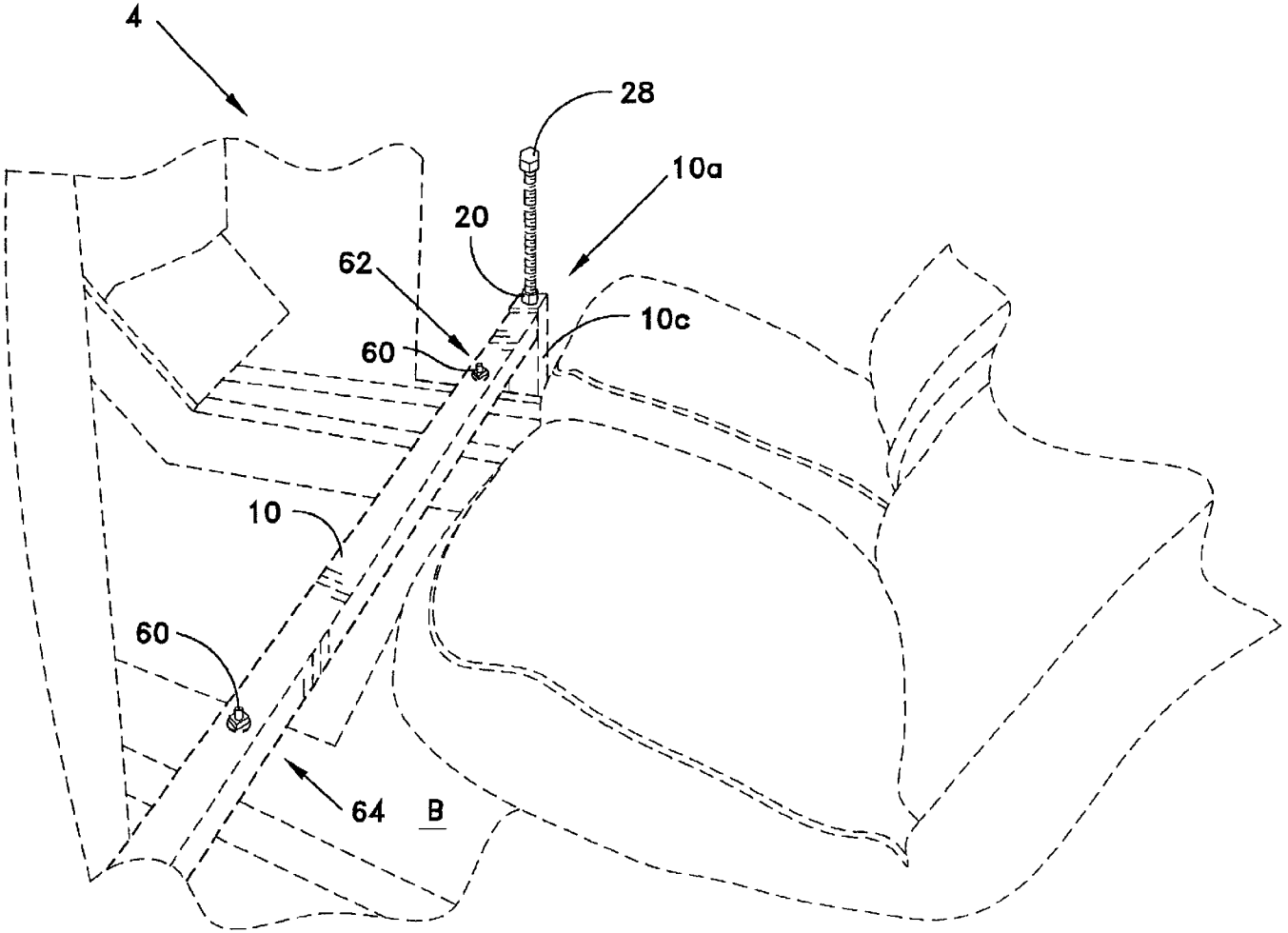
FIG. 2A is a partial, perspective view of the vehicle body lifter according to the invention, illustrating frame attachment to a body portion of a vehicle.
Figure 2B:
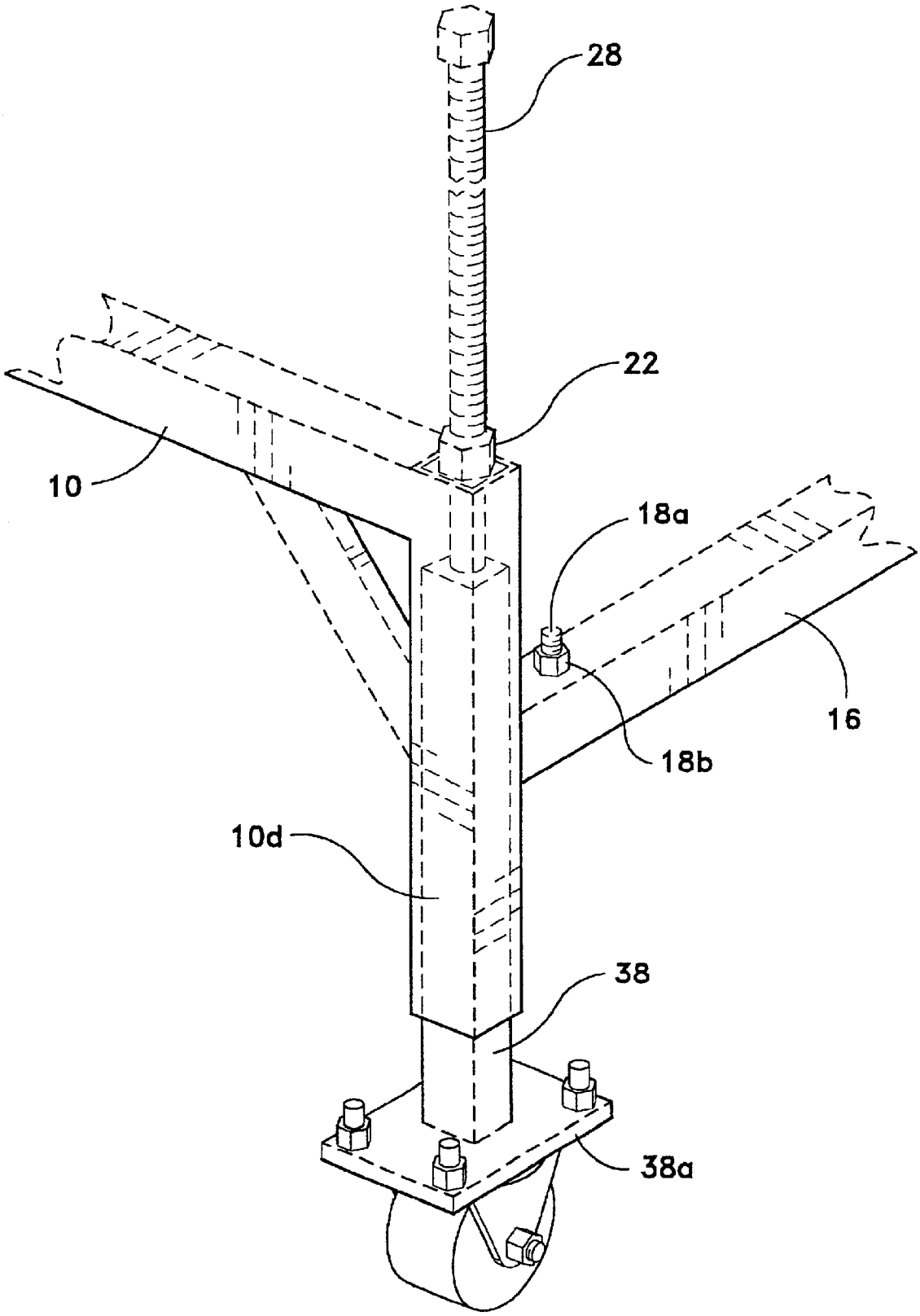
FIG. 2B is a partial, perspective view of the vehicle body lifter according to a first embodiment of the invention, illustrating internal lifting features.
Figure 2C:
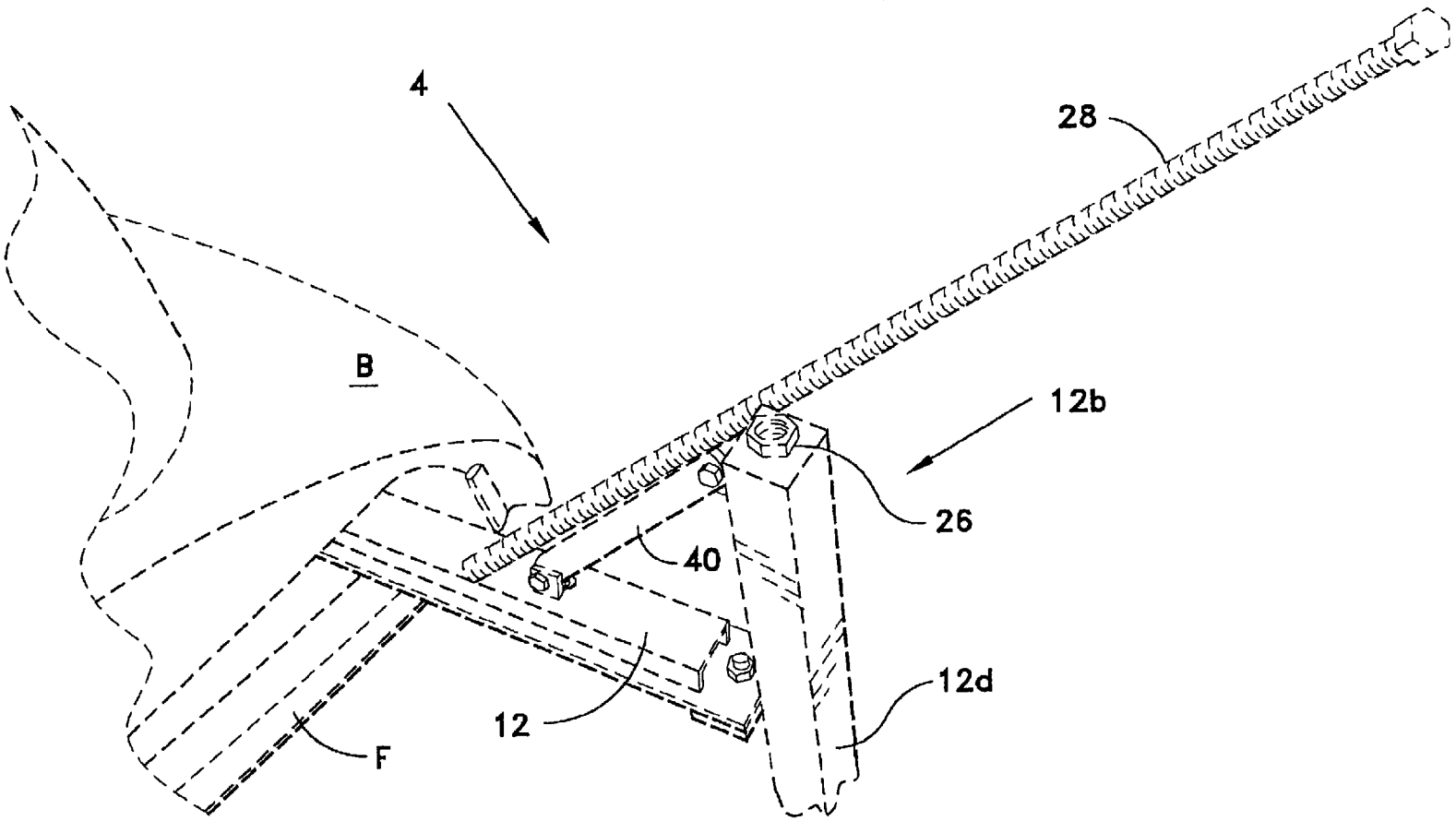
FIG. 2C is a partial perspective view of the vehicle body lifter according to the first embodiment, illustrating a threaded aperture and threaded lifting rod assembly.

As best seen in FIGS. 1–2C, a first embodiment of the vehicle body lifter 4 includes a first lift support member 10 and a second lift support member 12, which are interconnected by a first and second extension bar 14 and 16, respectively. Each extension bar 14,16 is pre-designed to accommodate specific body lengths of various vehicle models. Fasteners 18 are utilized to attach bars 14, 16 to substructure (not shown) of lift support members 10 and 12. The attachment fastener 18 is preferably a combination nut 18*a* and bolt 18*b*. At each corner of the first and second lift supports 10,12 are substantially rectangular tube structures 10*c*, 10*d* and 12*c*, 12*d*. Each rectangular tube is adapted to receive therein a solid rectangular post 38 whereby lift members 10, 12 may be adjusted up and down on posts 38. Each structure 10*c*, 10*d*, 12*c*, 12*d* is provided with a respective threaded aperture 20, 22, 24 and 26. Each threaded aperture 20, 22, 24 and 26 is configured and dimensioned to receive a single threaded adjusting rod 28. The adjusting rods 28 are inserted in a respective threaded aperture and are turned in a clock-wise direction therein until the end of the rods contacts the top of solid post 38. Further clock-wise turning of adjustment rods 28 will cause lift members 10 and 12 (and consequently 14, 16) to move upwardly on posts 38 whereby the body B, which is supported on members 10, 12, 14 and 16, will be lifted from the frame F.

The length of each threaded rod fastener 28 is predetermined based upon the lifting height range required for a specific body model of a vehicle. A base plate 38*a* is secured to the bottom of each solid post 38. A heavy-duty, swivel castor wheel 42 is fastened to each respective base plate. The vehicle body lifter 4 provides lifting support by mechanically fastening at least one lifting member 10, 12 to the body B. Lifting is achieved by turning each threaded rod 28 with either mechanical, hydraulic, pneumatic or electrical torque devices. As diagrammatically illustrated in FIG. 1, a technician T is shown operatively manipulating each rod 28 via a pneumatic wrench 50. It has been determined that a lifting height of three inches per rod is required to adequately separate the body B from frame F for most automobiles.

FIGS. 2A–2C, further illustrate details of the first embodiment of the invention. In FIG. 2A, the vehicle body lifter 4 is shown attached to the body B via mechanical fasteners 60 at first and second body attachment areas 62 and 64, respectively. In FIG. 2B, a detailed illustration of the features of the corner portion of lift support member 10 is shown. The features include a structural reinforcement member 40 attached across a diagonal of the lift support member 10 to improve overall structural stability of the vehicle body lifter 4. Accordingly, a number of structural reinforcement members can be fixedly attached at selective locations of the lifter 4 to reduce the probability of material fracture and/or metal fatigue in areas where localized stress occurs. The method of attachment of the reinforcement members can be by welding or the use of mechanical fasteners depending on the magnitude or load of the body B. As diagrammatically illustrated in FIG. 2C, structural reinforcement member 40 is shown attached along a diagonal of lift support member 12.

Figure 3:
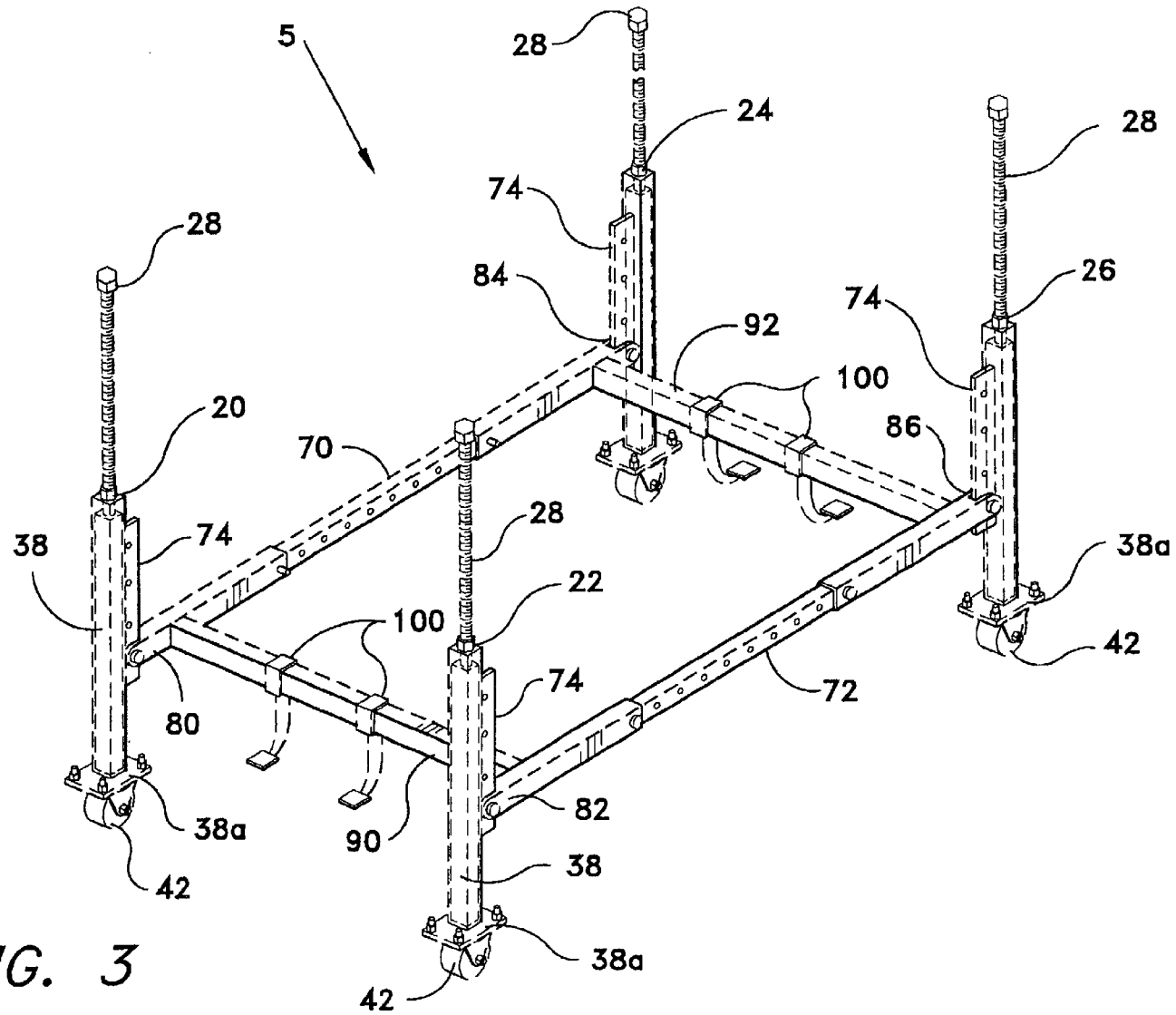
FIG. 3 is a perspective view of the vehicle body lifter according to a second embodiment.

A second embodiment of the instant invention is illustrated in FIG. 3 and is generally indicated at 5. With respect to lifting, this embodiment operates under same principle as the first embodiment. The instant embodiment provides for a respective vertically-apertured face plate 74 to be attached to each of the rectangular tube structures 10*c*, 10*d*, 12*c* and 12*d*. Telescopically adjustable extension arms 70 and 72 are mounted to the face plates 74 and are vertically adjustable therein. Insertable pins 80, 82, 84 and 86 are employed to mount the adjustable extension arms 70, 72 to the face plates. First and second cross-beams 90 and 92 are fixedly attached in parallel to extension arms 70 and 72. Hook members 100 are slidably mounted on cross-beams 90 and 92 and function as auxiliary support members 100 for body B.

Figure 4:
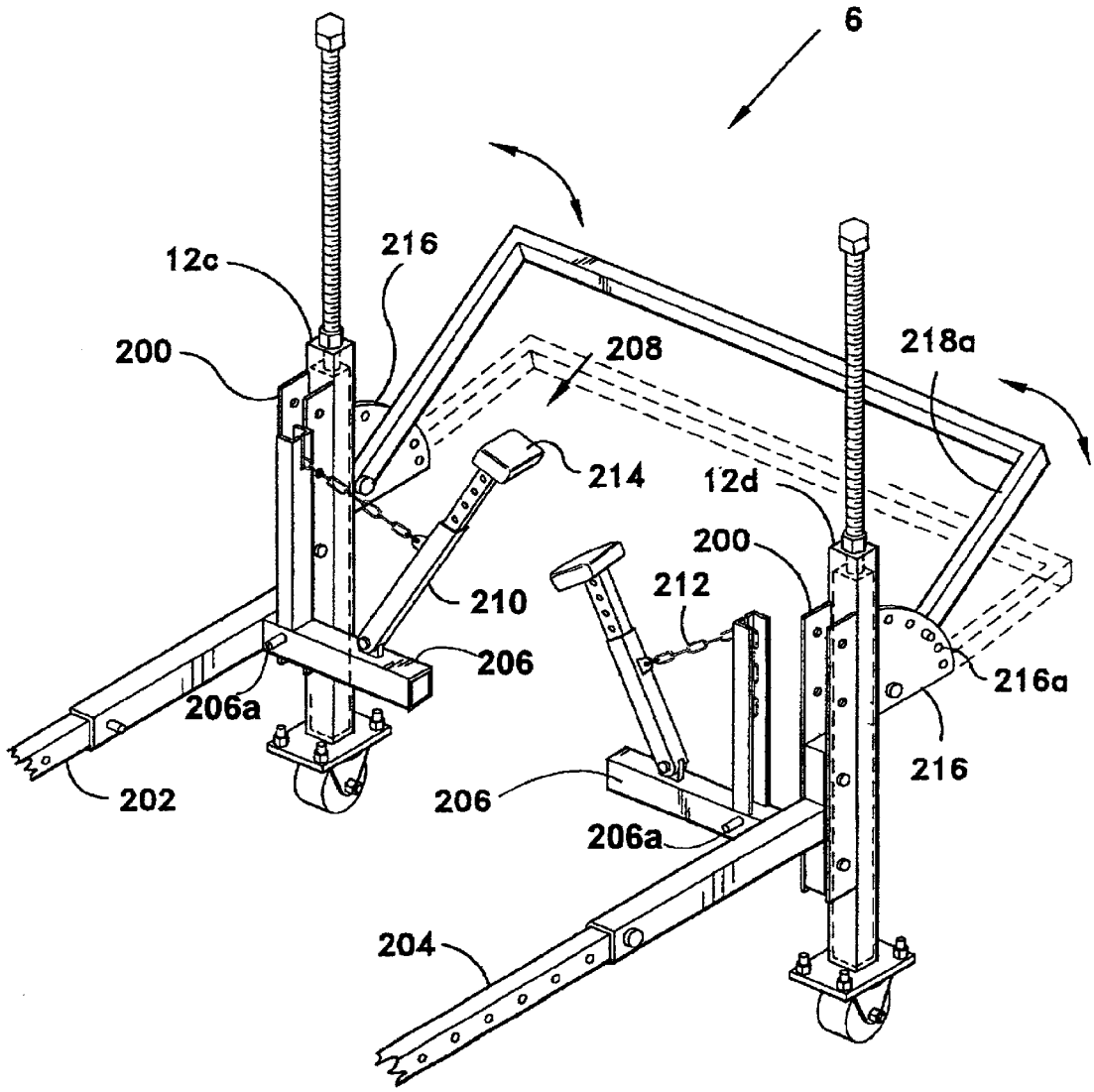
FIG. 4 is a perspective view of the vehicle body lifter according to a third embodiment, illustrating an attachment extension.

A third embodiment of the invention is illustrated in FIG. 4 and is generally indicated at 6. The third embodiment incorporates a pair of vertically-apertured, spaced face plates 200 respectively attached to each of the rectangular tube structures 10*c*, 10*d*, 12*c* and 12*d*. Extension arms 202, 204 are provided with apertured T-shaped ends for adjustably nesting within the spaced face plates. Pins are employed to attach the T-shaped ends to the spaced face plates. Tubes 206 are removably attached by pins 206*a* to partially span the distance between tubular members 12*c* and 12*d*. A respective wheel well lifter 208 is attached at opposite ends of each tube 206*a*. The lifter functions to fit in the wheel well of the body to enhance the lifting process. Wheel well lifter 208 includes a telescopically adjustable tube 210 which is pivotally mounted on cross-beam 206. A chain 212 is employed to adjust and lock lifter 208 at an optimum angle. A thick, high density foam pad 214 is secured to the end of tube adjustable 210. Pad 214 will cushion the effect of the lift to prevent damage caused by lifting stresses. Wedge-shaped plates 216 are attached to members 12*c* and 12*d* on a face opposite to face plates 200. Plates 216 are provided with spaced apertures 216*a* along an arcuate edge thereof. A U-shaped lifting arm 218 is provided with apertured ends 218*a* such that arm 218 may be adjustably positioned on plates 216. A removable pin is utilized to accomplish the adjustment. Although shown at only one end of the device, it is obvious that the U-shaped lifting arm arrangement could be installed at both ends if desired.

It is to be understood that the present invention is not limited to the sole embodiments described above, but encompasses any and all embodiments within the scope of the following claims.

I claim:

1. A vehicle body lifter, including:

at least four hollow tubular support members, each of said hollow tubular support members having a top surface;

at least four solid post members, each of said solid post members telescopically received in a respective one of said hollow tubular support members;

a first extension arm support member, said first extension arm having a first end and a second end;

a second extension arm support member, said second extension arm support member having a first end and a second end;

means for attaching said first end of said first extension arm support member to a first one of said hollow tubular member;

means for attaching said second end of said first extension arm support member to a second one of said hollow tubular members;

means for attaching said first end of said second extension arm support member to a third one of said hollow tubular members;

means for attaching said second end of said second extension arm support member to a fourth one of said hollow tubular members, whereby said first extension arm support member is spaced a distance in parallel relationship to said second extension arm support member;

a respective threaded adjustment rod disposed in the top surface of each of said hollow tubular members.

2. A vehicle body lifter as recited in claim 1, wherein said top surface of each said hollow tubular member has a threaded opening therein, said respective threaded adjustment rod being disposed in said respective threaded opening.

3. A vehicle body lifter as recited in claim 2, wherein each said solid post members has a top end and a bottom end, wherein each said top is received in said respective one of said hollow tubular support members.

4. A vehicle body lifter as recited in claim 3, including a swivel, caster wheel attached to said bottom end of each said solid post members.

5. A vehicle body lifter as recited in claim 4, including a pair of cross-beams, said pair of cross-beams disposed perpendicularly to extending across at least a part of said distance between said first extension arm support member and said second extension arm support member.

6. A vehicle body lifter as recited in claim 5, including at least one hook support member mounted on each of respective cross-beam.

7. A vehicle body lifter as recited in claim 5, wherein said means for attaching includes a nut and bolt.

8. A vehicle body lifter as recited in claim 5, wherein said means for attaching includes a respective, vertically apertured plate fixed to each of said hollow post members.

9. A vehicle body lifter as recited in claim 5, wherein said means for attaching includes a respective pair of vertically apertured plates fixed to each of said hollow post members.

10. A vehicle body lifter as recited in claim 5, wherein said first and said second extension arm support members are telescopically adjustable.

11. A vehicle body lifter as recited in claim 5, wherein at least one of said pair of cross-beams is removably mounted.

12. A vehicle body lifter as recited in claim 5, including a pair of wedge-shaped plates each one of said pair of wedge-shaped plates having an arcuate, apertured edge, said wedge-shaped plates being attached to a respective hollow tubular member;

a U-shaped lifting arm, said U-shaped lifting arm adjustably attached to said pair of wedge-shaped plates.

13. A vehicle body lifter as recited in claim 12, including at least one hook support member mounted on said U-shaped lifting arm.

14. A vehicle body lifter, including:

at least four hollow tubular support members, each of said hollow tubular support members having a top surface;

at least four solid post members, each of said solid post members telescopically received in a respective one of said hollow tubular support members;

a first extension arm support member, said first extension arm having a first end and a second end;

a second extension arm support member, said second extension arm support member having a first end and a second end;

means for attaching said first end of said first extension arm support member to a first one of said hollow tubular member;

means for attaching said second end of said first extension arm support member to a second one of said hollow tubular members;

means for attaching said first end of said second extension arm support member to a third one of said hollow tubular members;

means for attaching said second end of said second extension arm support member to a fourth one of said hollow tubular members, whereby said first extension arm support member is spaced a distance in parallel relationship to said second extension arm support member;

a pair of cross-beams, said pair of cross-beams disposed perpendicularly to extending across at least part of said distance between said first extension arm support member and said second extension arm support member; and a respective threaded adjustment rod disposed in the top surface of each of said hollow tubular members.

15. A vehicle body lifter as recited in claim 14, wherein said first and said second extension arm support members are telescopically adjustable.

16. A vehicle body lifter as recited in claim 14, wherein at least one of said pair of cross-beams is removably mounted.

17. A vehicle body lifter as recited in claim 16, including a pair of wedge-shaped plates each one of said pair of wedge-shaped plates having an arcuate, apertured edge, said wedge-shaped plates being attached to a respective hollow tubular member;

a U-shaped lifting arm, said U-shaped lifting arm adjustably attached to said pair of wedge-shaped plates.

18. A vehicle body lifter as recited in claim 17, including at least one hook support member mounted on said U-shaped lifting arm.

* * * * *